US007651097B2

(12) United States Patent
Kay et al.

(10) Patent No.: US 7,651,097 B2
(45) Date of Patent: Jan. 26, 2010

(54) TOY PLAY SET

(75) Inventors: Robert Kay, Wilmslow (GB); Andrew Needham, Bollington (GB); Stephen Lau, Los Angeles, CA (US); Gary Collins, Redondo Beach, CA (US)

(73) Assignee: Carterbench Product Development, Ltd., Macclesfield, Cheshire (GB)

( * ) Notice: Subject to any disclaimer, the term of this patent is extended or adjusted under 35 U.S.C. 154(b) by 421 days.

(21) Appl. No.: 11/182,112

(22) Filed: Jul. 15, 2005

(65) Prior Publication Data

US 2006/0066047 A1 Mar. 30, 2006

Related U.S. Application Data

(60) Provisional application No. 60/614,918, filed on Sep. 30, 2004.

(51) Int. Cl.
*A63F 1/02* (2006.01)
*A63F 1/06* (2006.01)
*A63F 1/10* (2006.01)

(52) U.S. Cl. ..... 273/294; 273/148 A; 273/293

(58) Field of Classification Search ..... 446/73, 446/75, 76; 273/293, 294, 150, 148 A, 286, 273/309, 287, 282.3, 148 R; D21/376, 378; 206/579, 315.1
See application file for complete search history.

(56) References Cited

U.S. PATENT DOCUMENTS

| | | | | | |
|---|---|---|---|---|---|
| 296,012 | A | | 4/1884 | Jackson | |
| 603,186 | A | | 4/1898 | Grittis | |
| 1,004,934 | A | * | 10/1911 | Taylor | 106/249 |
| 1,277,211 | A | * | 8/1918 | Graham | 235/123 |
| 1,579,276 | A | * | 4/1926 | Birnberg | 273/148 R |
| D81,336 | S | * | 6/1930 | Joseph | D21/379 |
| 2,205,298 | A | * | 6/1940 | Lindner | 211/59.1 |
| 2,544,594 | A | | 3/1951 | Goldfarb | |
| 2,717,156 | A | * | 9/1955 | Nelson | 273/248 |
| 2,818,262 | A | * | 12/1957 | Nanna | 273/150 |
| 2,975,547 | A | * | 3/1961 | Greve | 446/77 |
| D204,993 | S | * | 6/1966 | Brothers | D21/379 |
| 3,296,735 | A | | 1/1967 | Djedda | |
| 3,578,320 | A | | 5/1971 | Goldfarb et al. | |

(Continued)

FOREIGN PATENT DOCUMENTS

| | | |
|---|---|---|
| DE | 347574 | 1/1922 |

(Continued)

OTHER PUBLICATIONS

K'NEX, *K'Nex 2004* Catalogue, p. 4 (2004).

*Primary Examiner*—Gene Kim
*Assistant Examiner*—Alyssa M Hylinski
(74) *Attorney, Agent, or Firm*—Panitch Schwarze Belisario & Nadel LLP

(57) ABSTRACT

A toy play set contains a set of playing cards used to play at least one predetermined card game. The toy play set includes a generally elongated body having a closed configuration in which ends and a side wall generally surround a hollow interior and an open configuration in which the hollow interior is at least partially accessible. The cards are identically shaped and sized and sufficiently small to be completely stored within the body in its closed configuration. The body includes an internal spindle, and each of the cards has an opening allowing it to be mounted on the spindle.

12 Claims, 3 Drawing Sheets

U.S. PATENT DOCUMENTS 3,761,094 A * 9/1973 Belisle ..... 273/293
3,793,470 A * 2/1974 Christy et al. ..... 434/204
4,032,141 A 6/1977 Tanimura
4,103,774 A 8/1978 Shingyouchi
4,317,515 A * 3/1982 Feeley et al. ..... 206/315.1
4,408,763 A 10/1983 Simons
D272,223 S * 1/1984 Daenen ..... D7/629
4,433,504 A 2/1984 Terui
4,581,904 A 4/1986 Lehmann et al.
4,923,429 A 5/1990 Lewis
4,946,413 A 8/1990 Lehmann et al.
4,964,831 A 10/1990 Wolff
4,966,277 A 10/1990 Razzore
5,029,700 A 7/1991 Chen
5,035,324 A 7/1991 Bertrand
5,074,561 A 12/1991 Johnson
5,167,564 A 12/1992 Lord
5,197,735 A 3/1993 Land et al.
5,209,345 A 5/1993 Haugabook
5,224,894 A 7/1993 Nelson et al.
5,261,848 A 11/1993 Kaplan et al.
5,375,828 A 12/1994 Shikami
5,419,436 A 5/1995 Powell
5,540,611 A 7/1996 Lapoint et al.
5,803,306 A 9/1998 Lewis
5,879,008 A * 3/1999 O'Rourke ..... 273/309
5,897,418 A 4/1999 Spector
5,980,352 A 11/1999 Rigberg
5,996,781 A 12/1999 Glaser et al.
6,098,794 A 8/2000 Lin
6,117,502 A 9/2000 Liao
6,120,295 A 9/2000 Pracas
6,146,721 A 11/2000 Freynet
6,203,393 B1 3/2001 Flynn
6,216,857 B1 * 4/2001 Gordon et al. ..... 206/232
6,247,729 B1 6/2001 Kaufman
6,367,799 B1 * 4/2002 Sippel ..... 273/294
6,506,094 B1 1/2003 Chang
6,575,807 B2 6/2003 Spector
6,652,024 B2 11/2003 Prasatek
D483,418 S * 12/2003 Carr et al. ..... D21/376
6,719,606 B1 4/2004 Mukensturm
6,752,679 B1 6/2004 Lui
2002/0039609 A1 4/2002 Bezek et al.
2002/0182974 A1 12/2002 Grabianski
2004/0203317 A1 10/2004 Small
2005/0006845 A1 * 1/2005 Hardie ..... 273/292
2005/0012274 A1 1/2005 Ritter et al.
2005/0017452 A1 1/2005 Stein

FOREIGN PATENT DOCUMENTS

DE 25 11 441 A1 9/1976
GB 725420 3/1955

* cited by examiner

TOY PLAY SET

CROSS-REFERENCE TO RELATED APPLICATIONS

This patent application claims priority to U.S. Provisional Patent Application No. 60/614,918, filed Sep. 30, 2004, entitled "Toy Play Set", the disclosure of which is incorporated herein in its entirety by reference.

BACKGROUND OF THE INVENTION

This invention generally relates to toy play sets and, more particularly, to a toy play set for containing and playing a game, such as a card game. It is known to provide play sets for use with games. Conventional play sets are not well-suited for use by a child while riding in a vehicle, such as a car. It is believed that a play set adapted for use by a child riding in a car would be desirable.

BRIEF SUMMARY OF THE INVENTION

Briefly stated, the present invention is a toy play set for containing playing cards used to play at least one predetermined card game. The toy play set comprises a generally elongated body having a hollow interior, first and second opposing longitudinal ends, and a generally curved side wall extending around the hollow interior between the first and second ends. The first and second ends and side wall generally surround the hollow interior in a closed configuration of the body. The body has an open configuration in which the hollow interior is at least partially accessible. A plurality of individual playing cards form a set sufficiently complete to play the predetermined card game. The cards are identically shaped and sized and sufficiently small for the set of cards to be completely stored within the hollow interior of the body with the body in the closed configuration. The cards are accessible and removable from within the hollow interior of the body with the body in the open configuration to enable the cards to be at least individually withdrawn from and placed back into the hollow interior of the body.

In another aspect, the present invention is a toy play set for playing at least one predetermined card game. The toy play set comprises an arcuate body. A plurality of individual arcuate playing cards forms a set sufficiently complete to play the predetermined card game. The cards are identically shaped and sized and sufficiently small for the set of cards to be completely stored within the body.

In another aspect, the present invention is a combination set for playing at least one predetermined card game. The combination set comprises a body with a hollow interior. At least one member fixedly extends from the body into the hollow interior. A set of cards is shaped to fit in the hollow interior of the body. Each card of the set has an opening in the plane of the card extending entirely through the plane of the card. The openings and all cards of the set are identical to one another and are sized and shaped to receive the at least one member with the entire set of cards in the hollow interior of the body.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 2:
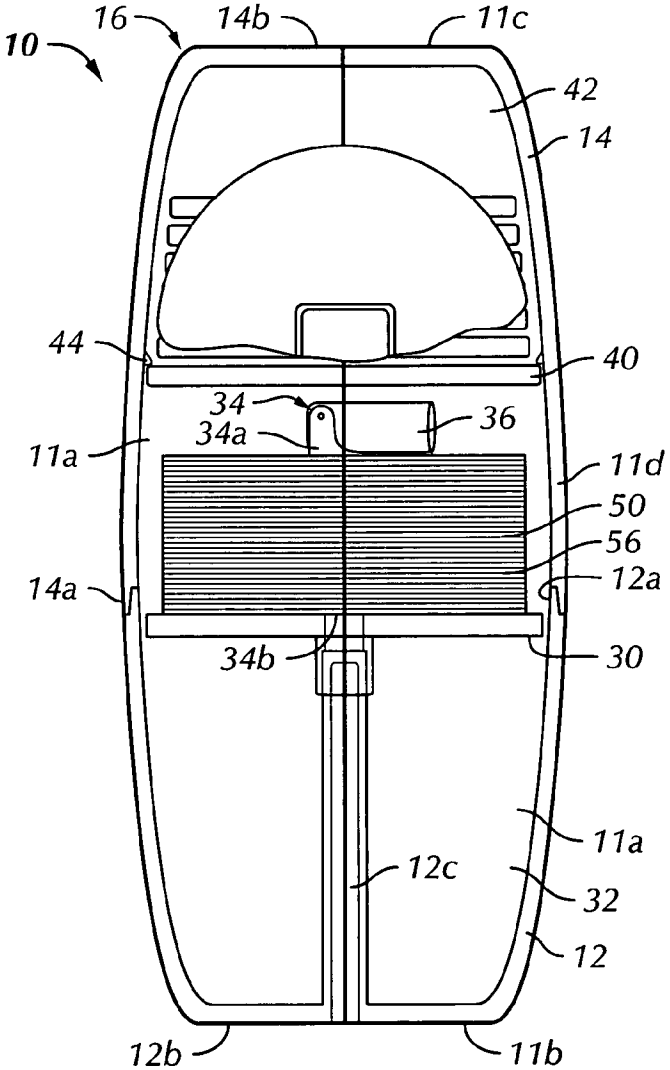
FIG. 2 is a cut-away view of the toy play set of FIG. 1.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Figure 1:
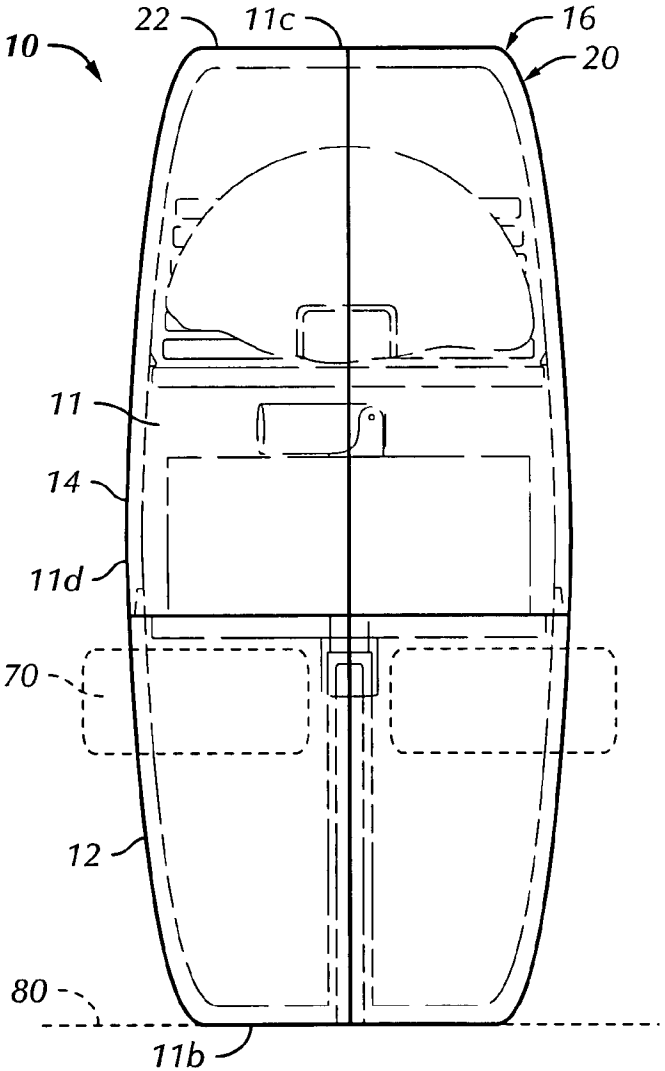
FIG. 1 is a front elevational view of a toy play set in accordance with a first preferred embodiment of the present invention.

Referring to the drawings in detail, wherein like numerals indicate like elements throughout, there is shown in FIGS. 1 and 2 a first preferred embodiment of a toy play set, indicated generally at 10, in accordance with the present invention. The toy play set 10 contains a set 56 of playing cards 50 used to play at least one predetermined card game. The toy play set 10 is intended to be used by children, preferably while traveling in vehicles (not shown). As such, the toy play set 10 is appropriately sized to fit in a standard beverage cup holder 70 of an automobile (not shown) or other such vehicle (not shown).

The toy play set 10 preferably includes a generally elongated body 11 having a generally hollow interior 11*a*, first and second opposing longitudinal ends 11*b*, 11*c*, and a generally curved side wall 11*d* extending around the hollow interior 11*a* between the first and second opposing longitudinal ends 11*b*, 11*c*, such that the body 11 is generally annular in transverse cross-section. Preferably the first and second opposing longitudinal ends 11*b*, 11*c* and the side wall 11*d* generally surround the hollow interior 11*a* in a closed configuration 16 of the body 11 (see FIGS. 1 and 2), such that the body 11 is essentially in the form of a canister having a generally frusto-ovoid shape. Although not shown in FIGS. 1 and 2, the body 11 of the first embodiment toy play set 10 also has an open configuration (generally similar to that shown in FIGS. 8 and 9) in which the hollow interior 11*a* is at least partially accessible, as will be described below.

The body 11 preferably includes a first, bottom portion 12 and a second, top portion 14 removably engageable with the first portion 12, which are preferably engaged in the closed configuration 16 and separated in the open configuration. The first and second portions 12, 14 are preferably cup-shaped, with each of the first and second portions 12, 14 having an open end 12*a*, 14*a* and an oppositely disposed closed end 12*b*, 14*b*. The open ends 12*a*, 14*a* of the first and second portion 12, 14 are preferably frictionally engaged with each other with the body 11 in the closed configuration 16 such that the closed ends 12*b*, 14*b* of the first and second portions 12, 14 respectively form the first and second ends 11*b*, 11*c* of the body 11. Specifically, a rim of the open end 12*a* of the first portion 12 preferably interlocks with a rim of the open end 14*a* of the second portion 14, e.g., by tongue and groove, mating threads, bayonet connectors, conventional snap fit or frictional sliding fit, etc., in order to releasably engage the first portion 12 with the second portion 14, such that the body 11 is generally shell-like when in the closed configuration 16. When in the closed configuration 16, the body 11 is intended to store all of the below-described game pieces within. Although this configuration is preferred, it is within the spirit and scope of the present invention that the first and second portions 12, 14 have other shapes and/or configurations, provided they can still function and perform as described herein.

Referring specifically to FIG. 2, the toy play set 10 preferably includes a plurality of individual playing cards 50 forming a set 56 sufficiently complete to play the predetermined card game. The cards 50 are preferably identically shaped and sized and sufficiently small for the set 56 of cards 50 to be completely stored within the hollow interior 11*a* of the body 11 with the body 11 in the closed configuration 16. It is preferred that the cards 50 are arcuate (i.e., have a generally curved outer perimeter), and specifically annular, in shape such that the shape of the cards 50 corresponds to the shape of the body 11 in cross-section. The cards 50 are preferably accessible and removable from within the hollow interior 11*a* of the body 11 in the open configuration to enable the cards 50 to be at least individually withdrawn from and placed back into the hollow interior 11*a* of the body 11, such as during play of the at least one predetermined game. However, this is not limiting as it is intended that the cards 50 be able to be withdrawn from and placed back into the body 11 at any time and not just during play of the at least one predetermined game.

Referring again to FIGS. 1 and 2, it is preferred that at least one of the first and second longitudinal ends 11*b*, 11*c* of the body 11 are sized and shaped to fit at least partially into the cup holder 70 sufficiently for the cup holder 70 to support the body 11 in a generally upright orientation 20 with the other of the first and second ends 11*b*, 11*c* forming a top end 22 of the body 11. It is further preferable that at least one of the first and second ends 11*b*, 11*c* is sufficiently flat to support the body 11 in a generally upright orientation 20 on a flat, horizontal support surface 80 with the other of the first and second ends 11*b*, 11*c* forming a top end 22 of the body 11. Preferably, the first and second ends 11*b*, 11*c* of the body 11 are each sized and shaped to fit at least partially into the cup holder 70 and are each sufficiently flat to support the body 11 in a generally upright orientation 20 on a flat, horizontal support surface 80. In this way, the body 11 can be supported by either a cup holder 70 or a flat surface 80 with either end 11*b*, 11*c* forming a top end 22 of the body 11. Such a configuration would also allow for the first and second portions 12, 14 of the body 11 to be separated so as to place the body 11 in the open configuration, with each of the first and second portions 12, 14 being separately retained and/or placed within a cup holder 70 or on a flat surface 80, thereby facilitating playing of the at least one predetermined game, as will be discussed below.

Referring specifically to FIG. 2, the first portion 12 of the body 11 preferably has a first lid 30 removably disposed therein to form a first compartment 32 within the first portion 12 between the first lid 30 and the closed end 12*b* of the of the first portion 12. The first portion 12 preferably has a rod 12*c* extending upwardly from an inner side of the closed end 12*b* of the first portion 12, such that the rod 12*c* is disposed entirely within the first portion 12. The first lid 30 is preferably mounted on a top of the rod 12*c* so as to be disposed proximate the open end 12*a* of the first portion 12 in at least the closed configuration 16 of the body 11. Although it is preferable that the first lid 30 be mounted on the top of the rod 12*c* of the first portion 12, it is within the spirit and scope of the present invention that the rod 12*c* be eliminated and that the first lid 30 be press fit within the open end 12*a* of the first portion 12 (see FIGS. 7-9 portraying a second embodiment, which is described below). It is preferred that the first lid 30 has a generally circular bottom side that essentially closes the open end 12*a* of the first portion 12.

The first lid 30 preferably has a spindle 34 extending outwardly therefrom in a direction away from the closed end 12*b* of the first portion 12 and terminating at a free, first end 34*a*. A second end 34*b* is preferably engaged with the first lid 30 in a known manner, such as, but not limited to, by press fitting, integrally molding, or fastening using glue or other adhesives or fasteners such as screws or bolts. The cards 50 preferably have holes 52 (see FIG. 6) therethrough sized to receive the spindle 34 therethrough. Preferably, the holes 52 are disposed through centers of the cards 50, although it is contemplated that the cards 50 have holes 52 disposed therethrough at locations other than the centers of the cards 50, such as, but not limited to, spaced inwardly from an outer perimeter of each card 50. Moreover, although arcuate, preferably annular cards 50 are preferred, it is within the spirit and scope of the present invention that the cards 50 be shaped differently. For example, the cards 50 could have a regular geometric shape such as that of a square, rectangle, triangle, or star, for instance, or a less symmetrical or even an asymmetrical shape, provided the cards 50 can fit within the body 11 of the toy play set 10 and function to play the at least one predetermined game. Although it is preferred that the spindle 34 extend outwardly from the first lid 30, it is within the spirit and scope of the present invention that the spindle 34 be configured differently, such as, but not limited to, extending directly outwardly from one of the first and second portions 12, 14, for instance, or being at least partially recessed into the first portion 12 (not depicted).

The spindle 34 is preferably sufficiently long to receive at least all of the cards 50 of the set 56 but at least sufficiently long so that at least some of the cards 50 can be placed on and retained by the spindle 34. Preferably, a spindle lock 36 is disposed at the free end 34*a* of the spindle 34. The preferred spindle lock 36 is rotatable with respect to the spindle 34 about a horizontal axis, such that it has a generally vertical, unlocked position and a generally horizontal, locked position. That is, when the spindle lock 36 is in the unlocked position, an axis of the spindle lock 36 is generally collinear with an axis of the spindle 34, and, when in the locked position, the axis of the spindle lock 36 is distinctly transverse, preferably generally perpendicular to the axis of the spindle 34. In this way, when in the locked position, the spindle lock 36 is intended to at least hinder the cards 50 from spilling off of or otherwise being removed from the spindle 34. When in the unlocked position, however, a user is able to slide a card 50 off of the spindle 34 and the spindle lock 36. Although this configuration is preferred, it is contemplated that the cards 50 can be releasably retained in the body 11 in other ways, for example, where the top of spindle 34 extends to/contacts and/or is received in a cover member such as a second lid 40 or other stop member (not shown) attached to the free end 34*a* of the spindle 34.

As stated above, the first lid 30 is preferably disposed within the first portion 12 proximate the open end 12*a*. Such a configuration allows the cards 50 disposed on the first lid 30 to be substantially exposed from the open end 12*a* of the first portion 12. Because the cards 50 are not held within the first portion 12, the cards 50 are easier to remove from the spindle 34 when the toy play set 10 is in the open configuration. Although this configuration is preferred, it is within the spirit and scope of the present invention that the first lid 30 be disposed within the first portion 12 such that the spindle 34 is contained at least partially within the first portion 12.

The second portion 14 of the body 11 preferably has a second lid 40 removably disposed therein to form a second compartment 42 within the second portion 14 between the second lid 40 and the closed end 14*b* of the second portion 14. The second lid 40 is preferably disposed between the open and closed ends 14*a*, 14*b* of the second portion 14.

The second lid 40 is preferably releasably engaged with the second portion 14, for example, by being press fit within an interior of the second portion 14, so as to enclose the second compartment 42. A generally annular shoulder 44 is preferably circumferentially disposed within the second portion 14 to extend slightly inwardly from a side wall of the second portion 14. The shoulder 44 essentially provides a stop against which the second lid 40 can be positioned so as to limit the amount the second lid 40 can be inserted within the second portion 14. The second lid 40 preferably has holes (not shown) therethrough, which aid in removal of the second lid 40 from the second portion 14. That is, when removing the second lid 40, the user can insert fingers within the holes of the second lid 40 in order to better grip the second lid 40. Although this configuration is preferred, it is within the spirit and scope of the present invention that other configurations be used, provided the toy play set 10 is capable of functioning as described herein.

When the body 11 is in the closed configuration 16, the cards 50 can be stored either within one of the first and second compartments 32, 42 (not shown) or on the spindle 34 between the first and second compartments 32, 42 (FIG. 2). When the body 11 is in the open configuration, the cards 50 are intended to be placed on the spindle 34, at least initially, in order to play the at least one predetermined card game.

Generally speaking, the at least one predetermined card game is played with the body 11 in the open configuration by individually drawing cards 50 to form a hand 54 (see FIG. 6) by removing the cards 50 from the spindle 34. The cards 50 are then individually discarded from the hand 54 by placing the cards 50 within the second portion 14. In this way, separate draw and discard piles of cards 50 are formed and are associated with the first and second portions 12, 14, respectively.

Preferably, the at least one predetermined game to be played using the toy play set 10 is UNO®, although it is within the spirit and scope of the present invention that other card games can be played using the toy play set 10 described herein, provided the cards 50 are adequate in number and have appropriate indicia thereon for playing of the other card games. For instance, a set of fifty-two playing cards having indicia of a standard deck of playing cards thereon could be used with the toy play set 10 for playing standard card games, such as gin, poker, go fish, etc. Moreover, it is contemplated that more than one deck of cards (not shown) be provided with the toy play set 10 so that the users can choose to play any of a number of predetermined card games with the toy play set 10.

Figure 6:
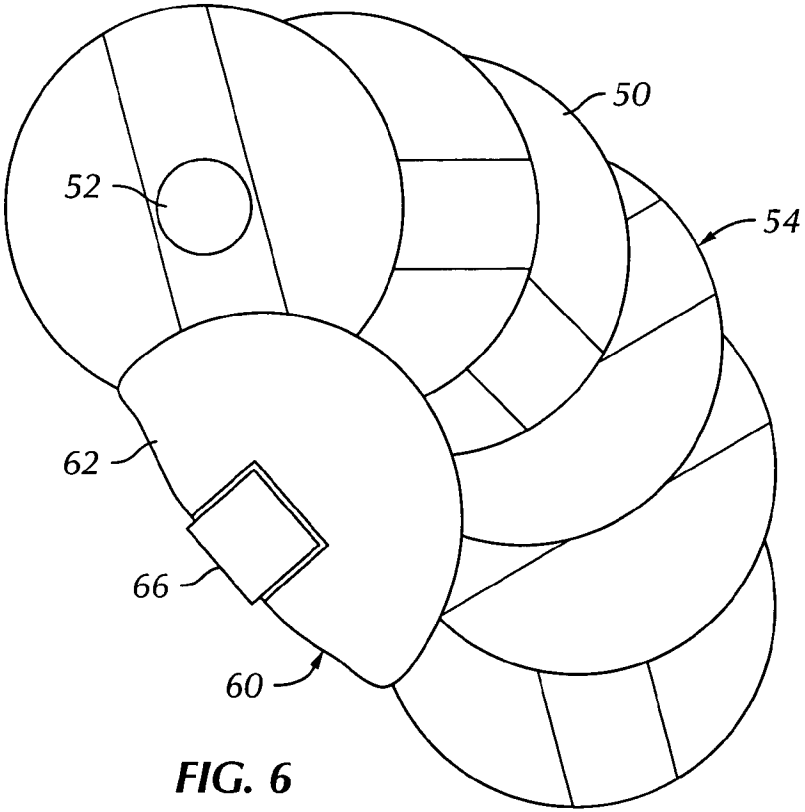
FIG. 6 is a front elevational view of the card holder of FIG. 3 clasping cards of the toy play set.

Referring to FIGS. 2-6, preferably, one or more card holders 60 are stored within toy play set 10 and are optionally used to facilitate holding of the hand 54 of cards 50 (see FIG. 6). The card holders 60 can be stored in one of the first and second compartments 32, 42 and retained therein by one of the first and second lids 30, 40, respectively, when the body 11 is in at least the closed configuration 16. Preferably, the card holders 60 are stored in the second compartment 42 and retained therein by the second lid 40, as shown in FIG. 2. Although it is preferable to store plural card holders 60 within the second compartment 42, it is within the spirit and scope of the present invention that other components of the toy play set 10 be stored therein, such as the cards 50, for instance, as described above. It is further contemplated that any card holders 60 not being used during play of the at least one predetermined card game be stored within one of the first and second compartments 32, 42 when the body 11 is in the open configuration.

Figure 3:
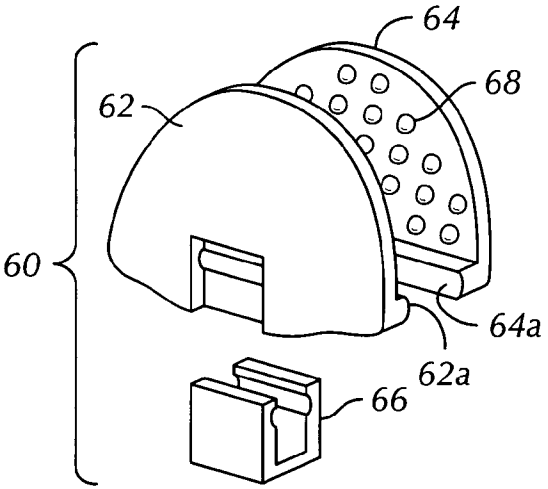
FIG. 3 is an exploded view of a card holder for use with the toy play set of FIG. 1.
Figure 4:
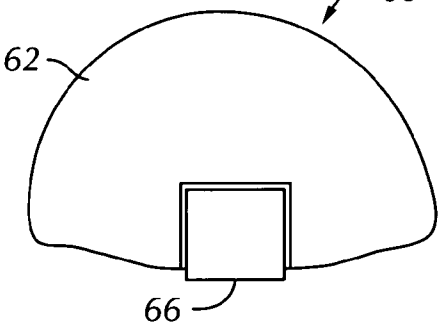
FIG. 4 is a front elevational view of the card holder of FIG. 3.
Figure 5:
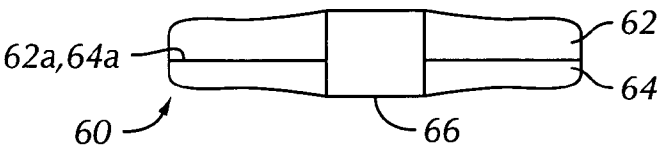
FIG. 5 is a bottom plan view of the card holder of FIG. 3.

Referring specifically to FIGS. 3-6, the card holders 60 include a front surface 62, a back surface 64, and a spring clip 66. Preferably, the spring clip 66 is metallic and functions to resiliently hold the front surface 62 and the back surface 64 together, such that the card holder 60 is similar to a "banana clip" style clip, although the spring clip 66 is preferably generally square-shaped, rather than being elongated like the typical "banana clip". In this way, the spring clip 66 maintains the front surface 62 and the back surface 64 in abutting relation when at rest. However, the user can separate the front and back surfaces 62, 64 in order to place cards 50 therebetween (see FIG. 6). The user can then allow the front and back surfaces 62, 64 to abut once again in order to retain the cards 50 therebetween. Facing surfaces 62*a*, 64*a* of the front and back surfaces 62, 64, respectively, can be configured to mate and partially overlap, as shown in FIGS. 3 and 5, to prevent their separation. Additionally, inner sides of the front and back surfaces 62, 64 can have a pattern thereon, such as, but not limited to molded or applied protrusions 68, to aid in gripping of the cards 50 by the card holders 60. In this way, the card holders 60 assist the user in holding the circular cards 50, which can be awkward to hold otherwise. Although this configuration of card holders 60 is preferred, it is within the spirit and scope of the present invention that the card holders 60 be configured differently, provided they are capable of functioning as described herein.

Figure 8:
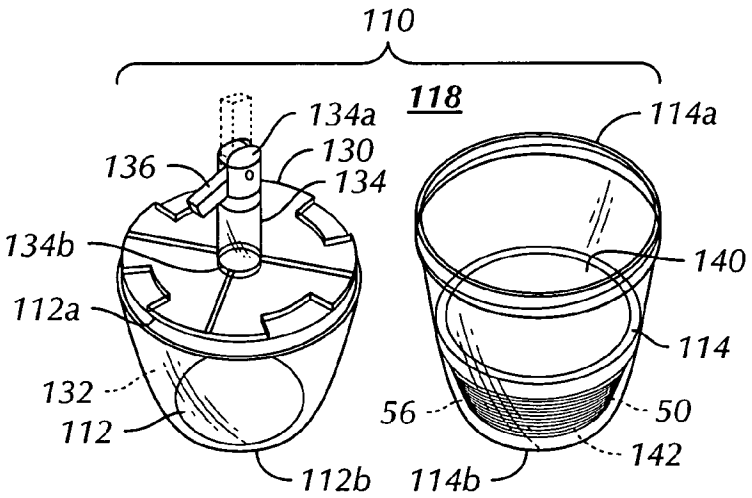
FIG. 8 is a top front perspective view of the toy play set of FIG. 7 in an open configuration.
Figure 9:
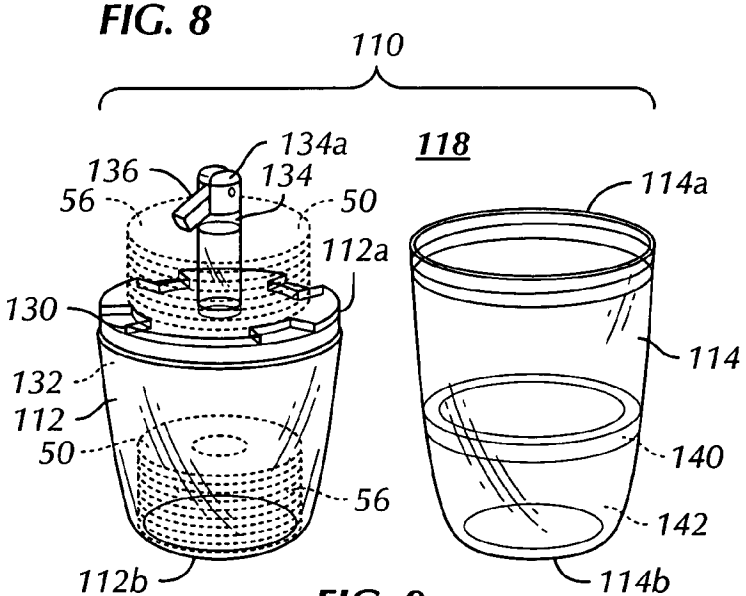
FIG. 9 is a front perspective view of the toy play set of FIG. 8.
Figure 7:
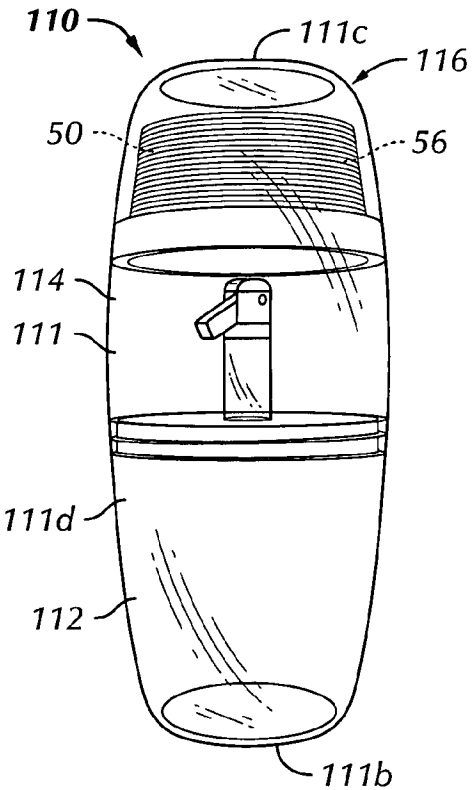
FIG. 7 is a front perspective view of a toy play set in accordance with a second preferred embodiment of the present invention, the toy play set being in a closed configuration.

With reference now to FIGS. 7-9, a second embodiment toy play set 110 is constructed and operated generally similarly to the first embodiment toy play set 10. In general, elements of the second embodiment play set 110 are assigned reference numbers incremented by 100 above corresponding elements of the first embodiment play set 10. For example, an element of the second embodiment play set 110 corresponding to the body 11 of the first embodiment is assigned a reference number of 111. As the structure and operation of the second embodiment play set 110 are generally similar to the structure and operation of the first embodiment play set 10, it is not necessary to describe the additional second embodiment play set 110 in further detail except to point out a few notable differences, as discussed below. It is noted, however, that an open configuration 118 of the second embodiment toy play set 110 has no corresponding first embodiment reference number. Additionally, it is noted that, although the second embodiment toy play set 110 is intended to be placed in a cup holder 70 or supported on a flat support surface 80 like the first embodiment toy play set 10, a generally upright orientation of the body 111 in which one of first and second ends 111*b*, 111*c* forms a top end is not specifically shown and, therefore, has no corresponding reference number to that of the first embodiment.

The main difference between the second embodiment toy play set 110 and the first embodiment toy play set 10 is that a first portion 112 of a body 111 of the second embodiment toy play set 110 has no rod extending from an inner surface of a closed end 112*b*, as is preferably included with the first embodiment toy play set 10. Because of this, a first lid 130 is removably engageable with an open end 112*a* of the first portion 112, rather than the end of the rod. The first lid 130 is preferably frictionally engaged within the open end 112*a*, although it is contemplated that other manners of engagement be used, such as, but not limited to threaded engagement or hinged engagement, for instance. Although not shown with the toy play set 110, the above-described card holders 60 can also be used with the toy play set 110.

Like the toy play set 10 of the first embodiment, the body 111 of the toy play set 110 can be placed in a closed configuration 116 (FIG. 7) to store all of the components of the toy play set 110 therein. The toy play set 10 can also be placed in an open configuration 118 (FIGS. 8 and 9) in order for the user to play at least a predetermined card game with the cards 50, as described above. When in the open configuration 118, the first portion 112 is preferably separated from the second portion 114.

The structural elements of the toy play set 10, 110 are preferably fabricated from conventional polymeric materials, such as polypropylene. Preferably, the polypropylene is semi-translucent so as to allow one to see through the body 11, 111 in order to see the contents within the body 11, 111. Although this is preferred, it is within the spirit and scope of the present invention that the structural elements of the toy play set 10, 110 be made of a different material, so long as the toy play set 10, 110 is capable of performing in the manner described herein.

In use, when in the closed configuration 16, 116, the toy play set 10, 110 can store all of the above-described components of the toy play set 10, 110 within the body 11, 111. The toy play set 10, 110 can be retained within the cup holder 70 of the vehicle to prevent the toy play set 10, 110 from moving around the interior of the vehicle during motion of the vehicle. Alternatively, because each of the first and second ends 11*b*, 11*c*, 111*b*, 111*c* preferably are substantially flat, the toy play set 10, 110 can be used on a flat surface 80. When the at least one predetermined card game of the toy play set 10, 110 is desired to be played, the body 11, 111 is opened by removing the second portion 14, 114 from the first portion 12, 112. The cards 50 are placed on the spindle 34, 134, if not already disposed thereon. The spindle lock 36, 136 is rotated to the generally vertical, unlocked position to enable the users to remove cards 50 from the spindle 34, 134. Depending on which of the first and second compartments 32, 42, 132, 142 the card holders 60 are stored in, the first or second lid 30, 40, 130, 140 is removed from within the first or second portion 12, 14, 112, 114 in order to retrieve the appropriate number of card holders 60 (the number of card holders 60 preferably corresponds to the number of users playing the game). Once the appropriate number of card holders 60 is removed from within the first or second compartment 32, 42, 132, 142, the first or second lid 30, 40, 130, 140 is replaced within first or second portion 12, 14, 112, 114. The desired number of cards 50 can then be removed from the spindle 34, 134 by the users and placed within the card holders 60 of the users. The users can then engage in playing the at least one predetermined card game by drawing from the stack of cards 50 on the spindle 34, 134 and discarding cards 50 into the second portion 14, 114, such that the discarded cards 50 rest within the second portion 14, 114 on the second lid 40, 140. Upon completion of play of the at least one predetermined card game, the components of the game are placed back within the first and second portions 12, 14, 112, 114 of the body 11, 111, and the first portion 12, 112 is reattached to the second portion 14, 114 to place the body 11, 111 back in the closed configuration 16, 116 until the next time the at least one predetermined game is desired to be played.

It will be appreciated by those skilled in the art that changes could be made to the embodiments described above without departing from the broad inventive concept thereof. For example, while the spindle locks 36, 136 are desirable and even preferred, they are not required. Moreover, spindles may be provided in both first and second portions 12, 14, 112, 114 for example, facing one another in the closed configuration 16, 116 of the body 11, 111, even abutting or interfitting in the closed configuration 16, 116. Additionally, while the first lids 30, 130 supporting the spindles 34, 134 are preferably removable, alternatively, they may be fixed in position in the first portion 12, 112.

It is understood, therefore, that this invention is not limited to the particular embodiments disclosed, but it is intended to cover modifications within the spirit and scope of the present invention.

We claim:

1. A toy play set for containing playing cards used to play at least one predetermined card game, the toy play set comprising:

a generally elongated body having a hollow interior, first and second opposing longitudinal ends, and a generally curved side wall extending around the hollow interior between the first and second ends, whereby the first and second ends and side wall generally surround the hollow interior in a closed configuration of the body, the body having an open configuration in which the hollow interior is at least partially accessible, the body having a first portion and a second portion removably engageable with the first portion, the first and second portions being engaged in the closed configuration and separated in the open configuration of the body, the first and second portions being cup-shaped, each of the first and second portions having an open end and an oppositely disposed closed end, the open ends of the first and second portions being frictionally engaged with each other with the body in the closed configuration with the closed ends of the first and second portions forming the first and second ends of the body, the first portion having a first lid removably disposed therein to form a first compartment within the first portion between the first lid and the closed end of the first portions, the first lid being disposed proximate the open end of the first portion in the closed configuration of the body, and the first lid having a spindle extending outwardly therefrom in a direction away from the closed end of the first portion and terminating at a free end; and a plurality of individual playing cards forming a set sufficiently complete to play the predetermined card game, the cards being identically shaped and sized and sufficiently small for the set of cards to be completely stored within the hollow interior of the body with the body in the closed configuration, the cards being accessible and removable from within the hollow interior of the body with the body in the open configuration to enable the cards to be at least individually withdrawn from and placed back into the hollow interior of the body.

2. The toy play set of claim 1, wherein the cards have holes therethrough, the holes being sized so as to receive the spindle therethrough.

3. The toy play set of claim 2, wherein the spindle is sufficiently long to receive all of the cards of the set so that at least some of the cards can be placed on and retained by the spindle.

4. The toy play set of claim 3, wherein the spindle has a spindle lock at the free end thereof to at least hinder removal of the cards from the spindle.

5. The toy play set of claim 3, wherein all of the cards can be stored on the spindle with the body in the closed configuration.

6. The toy play set of claim 1, wherein the second portion has a second lid removably disposed therein to form a second compartment within the second portion between the second lid and the closed end of the second portion.

7. The toy play set of claim 6, wherein the second lid is disposed between the open and closed ends of the second portion.

8. The toy play set of claim 6, wherein the cards can be stored within one of the first and second compartments with the body in the closed configuration.

9. The toy play set of claim 1, wherein the toy set further includes at least one card holder for facilitating holding of a hand of cards.

10. The toy play set of claim 9, wherein the at least one card holder is stored within the body in the closed configuration with the plurality of playing cards.

11. A combination set for playing at least one predetermined card game, the combination set comprising:

a body with a hollow interior and arcuate side wall;

at least one member fixedly extending from the body into the hollow interior; and a set of cards shaped to fit in the hollow interior of the body, each card of the set having an internal opening in the plane of the card extending entirely through the plane of the card, and spaced inwardly from an outer perimeter of the card, the openings and all cards of the set being identical to one another in size and shape and being sized and shaped to receive the at least one member with the entire set of cards in the hollow interior of the body;

the at least one member fixedly extending from the body being a spindle shaped and sized to fit through the opening of each card so as to mount the set of cards on the spindle.

12. A toy play set for containing playing cards used to play at least one predetermined card game, the toy play set comprising:

a generally elongated body having a hollow interior, first and second opposing longitudinal ends, and a generally curved side wall extending around the hollow interior between the first and second ends, whereby the first and second ends and side wall generally surround the hollow interior in a closed configuration of the body, the body having an open configuration, the body further having a first portion and a second portion removably engageable with the first portion, the first and second portions being engaged in the closed configuration and separated in the open configuration of the body in which the hollow interior is at least partially accessible, at least one of the first and second portions being cup shaped with an open end and an opposing closed end, the closed end defining one of the first and second longitudinal ends of the body sized and shaped to fit at least partially into a vehicle cup holder sufficiently for the cup holder to support the body in a generally upright orientation with the other of the first and second longitudinal ends forming a top end of the body, the closed end of the at least one of the first and second portions being sufficiently flat to support the body in a generally upright orientation on a flat, horizontal support surface without the vehicle cup holder;

a spindle supported by one of the first and second body portions so as to be fully enclosed by the body in the closed configuration of the body; and a plurality of individual annular playing cards forming a set sufficiently complete to play the predetermined card game, the cards being identically shaped and sized and sufficiently small for the set of cards to be completely stored within the hollow interior of the body with the spindle in the closed configuration of the body, each of the cards having an at least generally central hole therethrough, the holes being sized so as to receive the spindle therethrough, the cards being accessible and removable from within the hollow interior of the body with the body in the open configuration to enable the cards to be at least individually withdrawn from and placed back into the hollow interior of the body in the open configuration.

* * * * *